US010299575B2

(12) United States Patent
Andrews

(10) Patent No.: US 10,299,575 B2
(45) Date of Patent: May 28, 2019

(54) SPORTS WATER BOTTLE HOLDER

(76) Inventor: Vanessa Andrews, Danbury, CT (US)

( * ) Notice: Subject to any disclaimer, the term of this patent is extended or adjusted under 35 U.S.C. 154(b) by 120 days.

(21) Appl. No.: 12/842,272

(22) Filed: Jul. 23, 2010

(65) Prior Publication Data

US 2012/0018465 A1 Jan. 26, 2012

(51) Int. Cl.

| | |
|---|---|
| ***A45F 5/00*** | (2006.01) |
| ***A45F 5/02*** | (2006.01) |
| ***A45F 3/14*** | (2006.01) |
| *A45F 3/00* | (2006.01) |
| *A45F 3/18* | (2006.01) |

(52) U.S. Cl.

CPC ..... *A45F 5/021* (2013.01); *A45F 3/14* (2013.01); *A45F 5/00* (2013.01); *A45F 3/005* (2013.01); *A45F 3/18* (2013.01); *A45F 2200/0583* (2013.01)

(58) Field of Classification Search

CPC .... A45F 5/021; A45F 5/00; A45F 3/14; A45F 3/005; A45F 3/18; A45F 2200/0583

USPC ..... 224/148.1, 148.3–148.7

See application file for complete search history.

(56) References Cited

U.S. PATENT DOCUMENTS

| | | | | |
|---|---|---|---|---|
| 5,147,079 | A | 9/1992 | Heather | |
| 5,529,228 | A * | 6/1996 | Biagi | 224/148.5 |
| D373,677 | S | 9/1996 | Kelly | |
| 5,622,346 | A * | 4/1997 | Story, Jr. | 248/311.2 |
| 5,664,721 | A * | 9/1997 | Homeyer | A01K 97/08 224/149 |
| 5,669,170 | A * | 9/1997 | Norris | F41C 33/00 224/150 |
| 5,803,333 | A * | 9/1998 | Fawcett | 224/652 |
| 5,806,730 | A * | 9/1998 | Deno | 224/148.6 |
| D410,770 | S | 6/1999 | Bergara | |
| 5,927,581 | A * | 7/1999 | Reddy et al. | 224/578 |
| 5,975,393 | A * | 11/1999 | Bellamy | A01K 97/08 206/315.11 |
| 6,032,841 | A * | 3/2000 | Johnson | 224/463 |
| 6,182,872 | B1 * | 2/2001 | Six | 224/148.5 |
| 6,290,114 | B1 * | 9/2001 | Berberian | A45F 3/04 224/637 |
| 6,390,346 | B1 * | 5/2002 | Thomas | A45F 3/14 224/236 |
| 6,401,993 | B1 * | 6/2002 | Andrino | 224/148.5 |
| 6,681,974 | B2 * | 1/2004 | Rotter | 224/662 |
| 6,712,250 | B2 * | 3/2004 | Vigny | A45F 3/04 224/637 |
| 7,090,102 | B1 * | 8/2006 | Lipke | 224/250 |
| 7,520,412 | B2 * | 4/2009 | Willows et al. | 224/148.4 |
| 7,568,599 | B2 * | 8/2009 | Hall | A45F 3/10 224/250 |
| 7,735,701 | B2 * | 6/2010 | Eberle | A45F 3/04 224/149 |
| 7,770,766 | B2 * | 8/2010 | Foissac | A45F 3/047 224/262 |
| 8,870,045 | B1 * | 10/2014 | Aguirre | A45F 3/04 224/581 |

(Continued)

*Primary Examiner* — Peter N Helvey
(74) *Attorney, Agent, or Firm* — AP Patents

(57) ABSTRACT

An apparatus for holding a beverage container while a user is engaging in one of walking, running, and sporting activities, such apparatus comprises a holder member having a predetermined shape, a predetermined size and formed of a predetermined material and a means secured to such holder member for attaching the holder member to a persons waist.

18 Claims, 7 Drawing Sheets

(56) References Cited

U.S. PATENT DOCUMENTS

2005/0092788 A1* 5/2005 Jenkins ..... 224/148.6

* cited by examiner

SPORTS WATER BOTTLE HOLDER

FIELD OF THE INVENTION

The present invention relates, in general, to an apparatus for holding a water bottle, and, more particularly, the present invention relates to an apparatus that provides a simple way to carry a water bottle around the user's waist.

BACKGROUND OF THE INVENTION

When playing sports, people can become dehydrated. Running to a bench or some other location to retrieve a drink of water is mot only time consuming but is not always possible, particularly if the person is a runner and gets far away from a drink location. Having a way to carry one's water or other beverage could save them time and energy while the person is participating in various activities.

Thus, it would be advantageous if there were a simple and secure means for carrying a bottle with water or some other beverage on the person so that the beverage would be with him/her and be available when needed.

SUMMARY OF THE INVENTION

The present invention provides an apparatus for holding a beverage container while a user is engaging in one of walking, running, and sporting activities, such apparatus comprises a holder member having a predetermined shape, a predetermined size and formed of a predetermined material and a means secured to such holder member for attaching the holder member to a persons waist.

OBJECTS OF THE INVENTION

It is, therefore, one of the primary objects of the present invention to provide an apparatus that can carry a beverage bottle on a person secured around the waist of the individual.

Another object of the present invention is to provide an apparatus for holding a beverage container wherein the bottom portion of the holder member is formed of a mesh material.

Still another object of the present invention is to provide an apparatus for holding a beverage container that is thermally insulated.

Yet another object of the present invention is to provide an apparatus for holding a beverage container that is formed from one of leather, plastic, rubber or combinations thereof.

In addition to the above described objects and advantages of the present invention, various other objects and advantages of the outdoor hot cooking utensil holding apparatus will become more readily apparent to those persons skilled in such art from the more detailed description, particularly, when such description is taken in conjunction with the attached drawing figures and with the appended claims.

BRIEF DESCRIPTION OF THE DRAWINGS

FIG. 2 is a perspective view of the sports bottle holder according to an alternate embodiment of the invention where the holder is held in place with a loop that a user's belt passes through.

Figure 1:
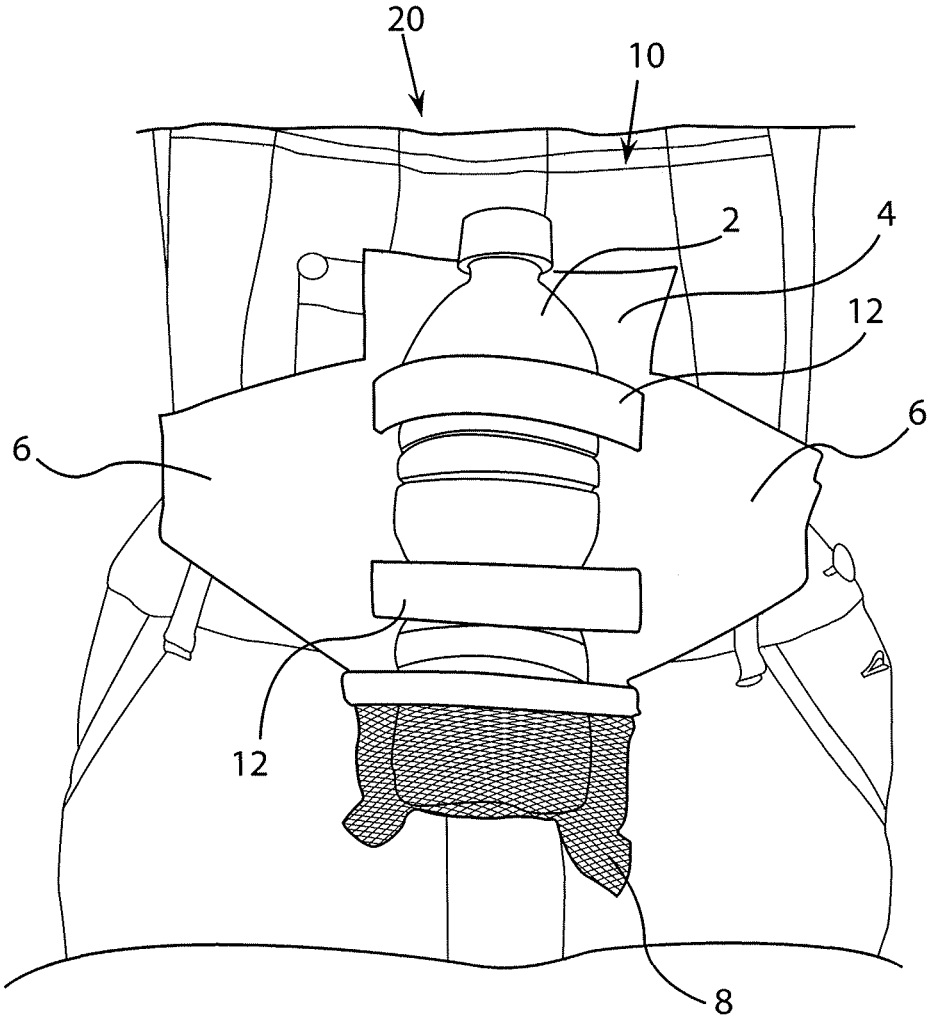
FIG. 1 is a perspective view of the sports bottle holder according to an embodiment of the invention.

DETAILED DESCRIPTION OF THE PRESENTLY PREFERRED AND VARIOUS ALTERNATIVE EMBODIMENTS OF THE INVENTION

Prior to proceeding to the more detailed description of the invention, it should be noted that, for the sake of clarity, identical components, having identical functions have been identified with identical reference numerals throughout the several drawing figures.

The present invention provides an apparatus, generally designated 10, for holding a beverage container 2 while a user is engaging in one of walking, running, and sporting activities. Such apparatus 10 comprises a holder member 4 having a predetermined shape, a predetermined size and formed of a predetermined material and a means, generally designated 20 secured to such holder member 4 for attaching the holder member 4 to a persons waist.

Such means 20 for securing such holder member to a person's waist is selected from a group including a clip, a strap, a belt, a loop, snaps, and hook and loop material 30.

In one embodiment of the invention such holder member 4 includes wing like members 6 engageable on a first end with sides of the holder member 4 and further engageable on a second end with a strap 8 for attaching the holder member 4 to such person's waist. It is presently preferred that a bottom portion of said holder member 4 is formed of a mesh material 8 so as to prevent any water from collecting therein.

The predetermined shape of the holder member 4 is substantially cylindrical so as to be able to accommodate commercial beverage containers which are generally cylindrical.

The predetermined size of the holder member includes a height of between about 14 to about 16 inches so as again to accommodate beverage containers of various sizes and is sufficiently large enough to support a 20 ounce beverage container.

Figure 3:
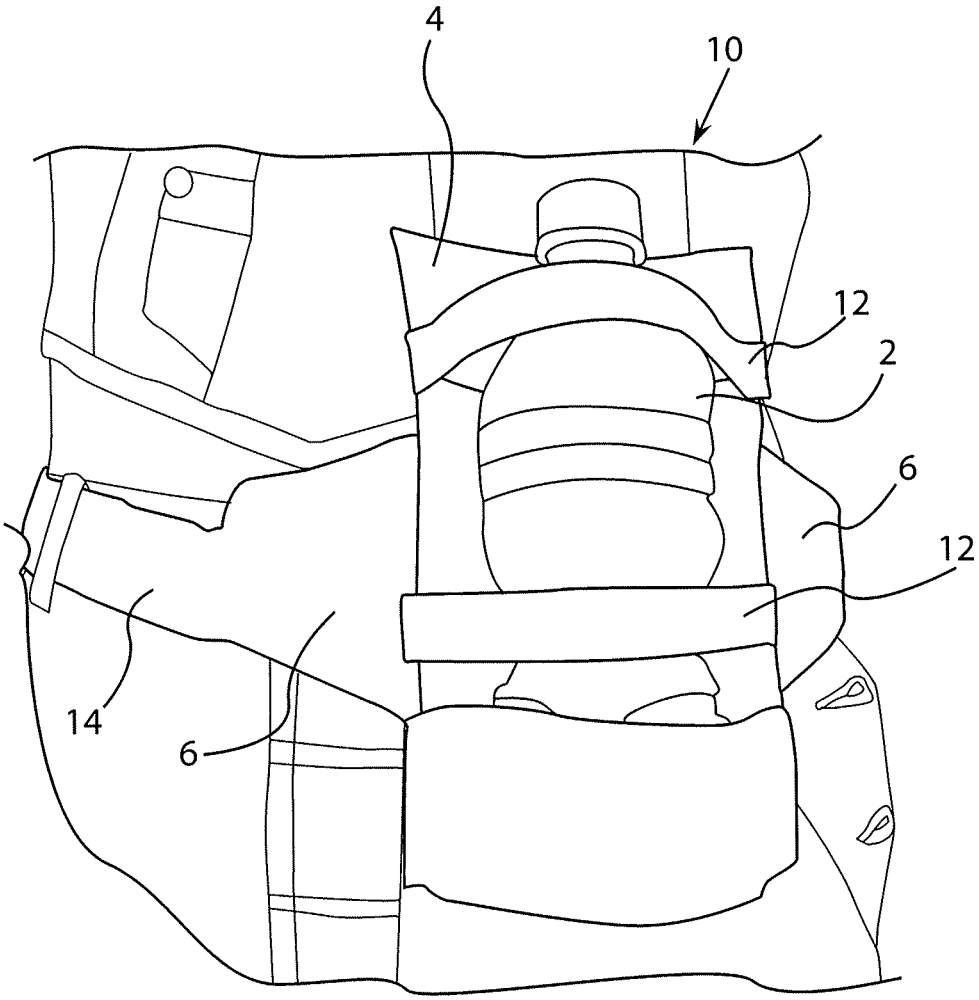
FIG. 3 is a perspective view of the sports bottle holder according to the embodiment shown in FIG. 1 wherein the holder is attached to a strap that encircles a user's waist.

It is also presently preferred that such holder member includes at least two circumferentially disposed straps 12 for holding such beverage container. One variation of this embodiment includes a holder member 4 wherein the holder member 4, the wings 6 and the circumferential straps and the straps for encircling a user's waist 14 are formed as a single unit as seen in FIGS. 1 and 3.

Figure 2:
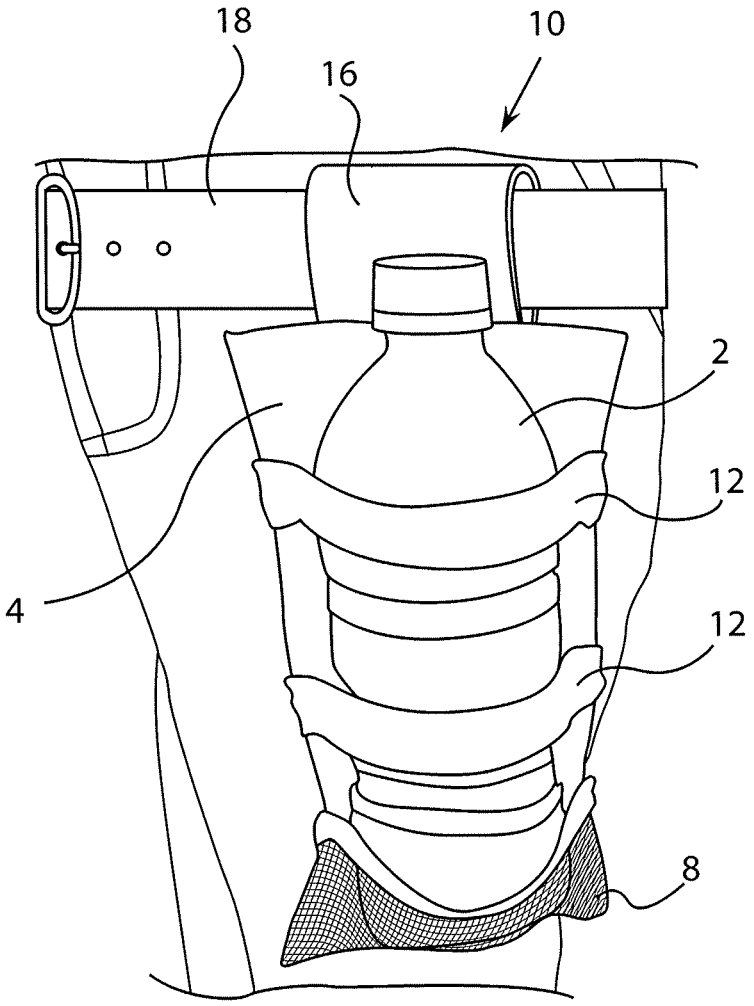

FIG. 2 shows the embodiment where the means 20 includes a loop 16 through which a belt 18 passes through and holds the holder member 4 in place.

Figure 4:
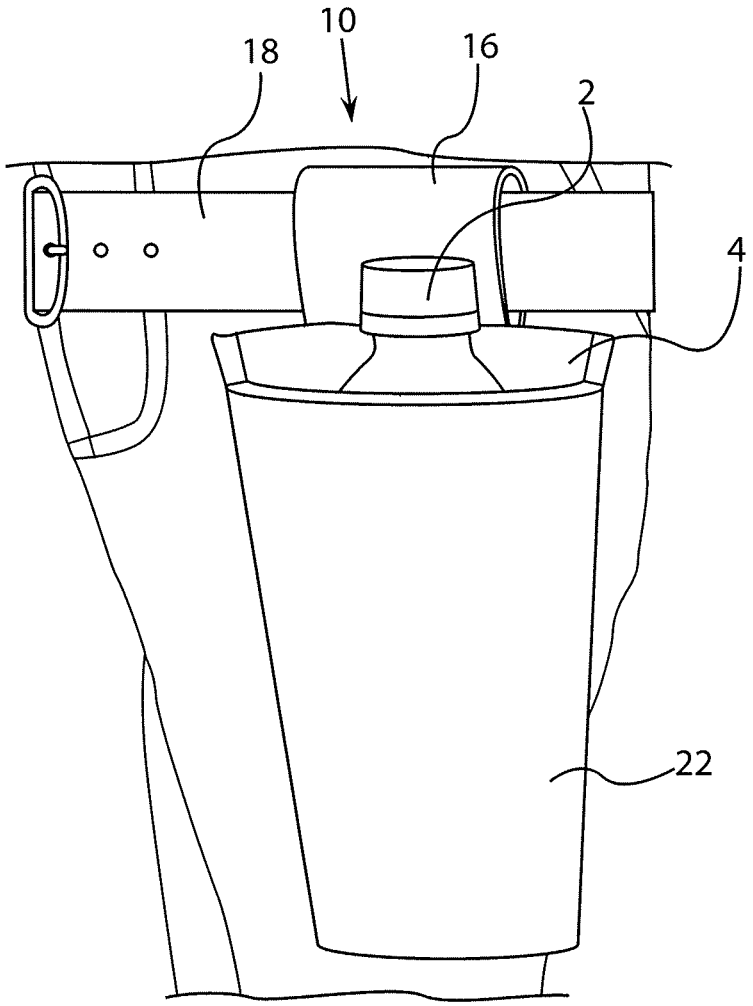
FIG. 4 is a perspective view of the sports bottle holder according to another alternate embodiment of the invention wherein the holder member is thermally insulated and is closed except for the open top for adding the bottle.
Figure 5:
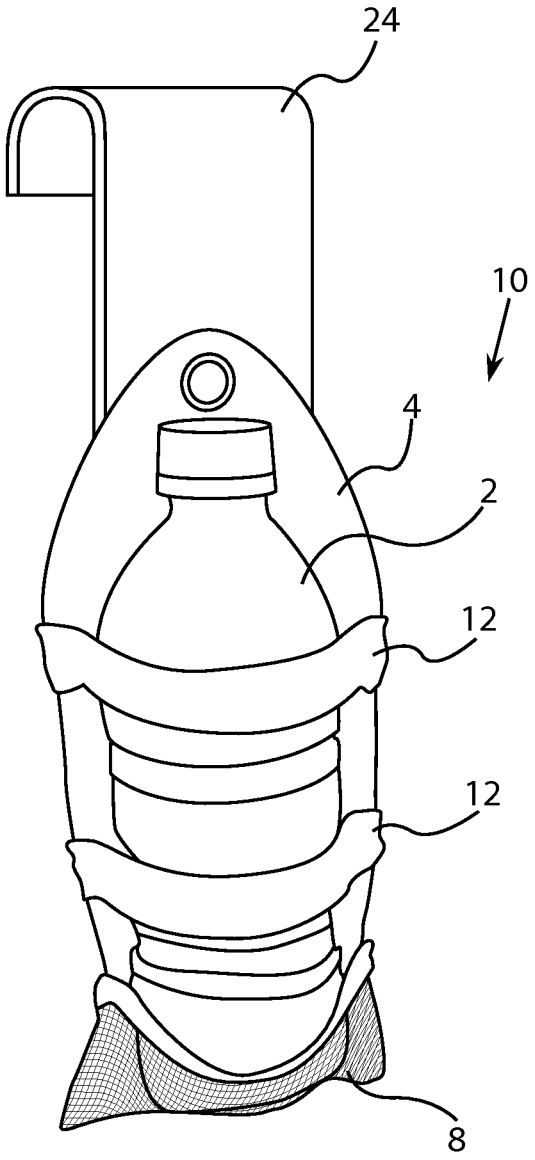
FIG. 5 is a perspective view of the sports bottle holder according to another alternate embodiment of the invention where the holder is held in place by means of a hook member that engages the belt or waistband of the user.
Figure 6:
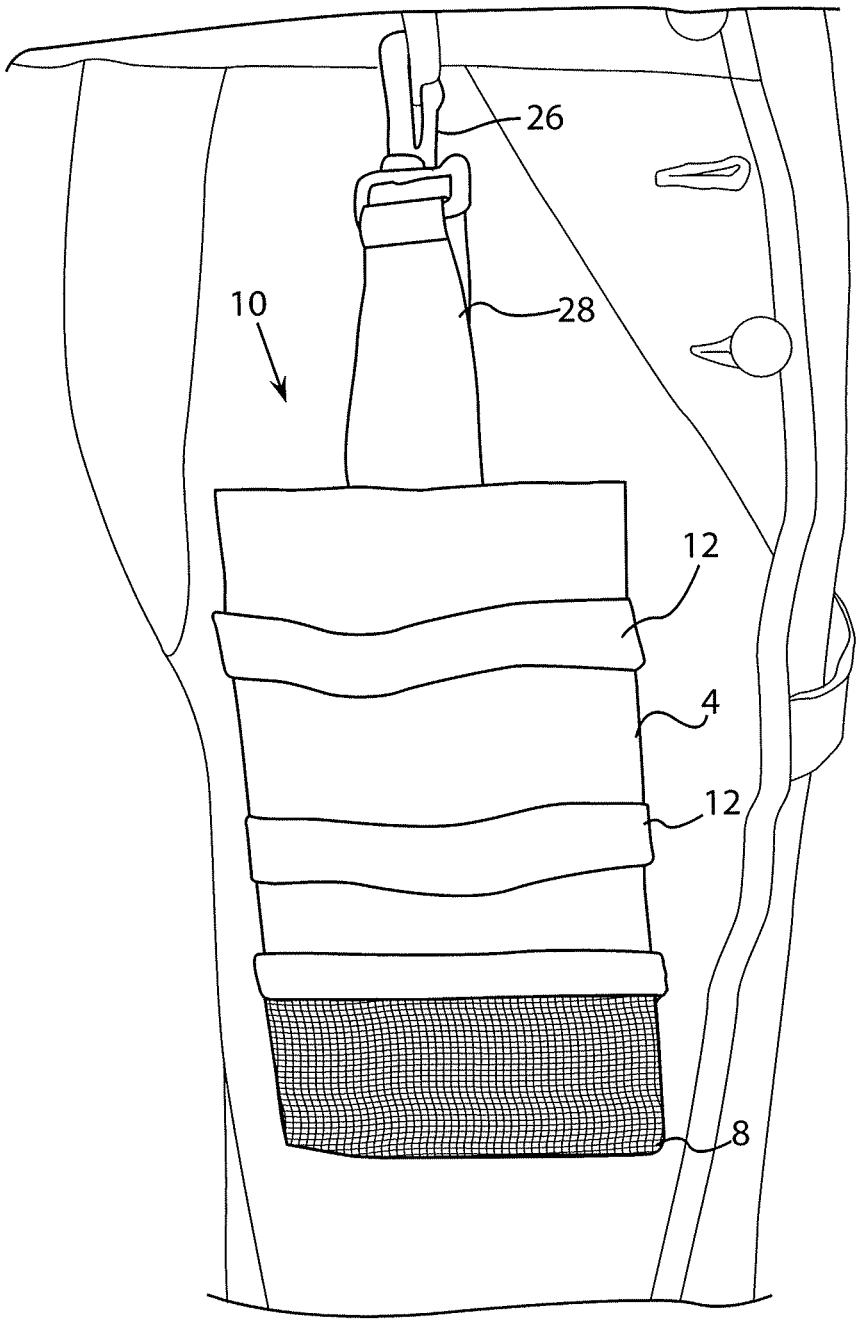
FIG. 6 is a perspective view of the sports bottle holder according to another alternate embodiment of the invention where the holder is held in place with a clip that engages a belt loop.
Figure 7:
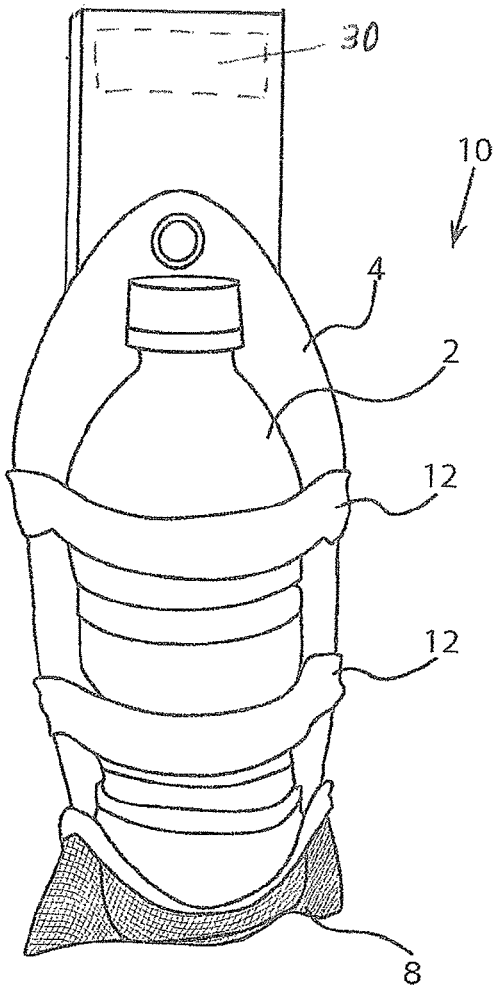
FIG. 7 is a perspective view of the sports bottle holder according to another embodiment of the invention where the holder is held in place with a hook and loop material.

In an alternate embodiment of the invention as seen in FIG. 4 such holder member 4 is formed of a thermally insulating material 22 designed to keep the beverage cold for a longer period of time. In this embodiment such predetermined shape of the holder member 4 is substantially cylindrical and does not have straps or a mesh bottom but is completely closed with the exception of the top opening for placing the container in the holder member 4.

Such predetermined material is selected from a group consisting of leather, plastic, rubber and combinations thereof. It is also within the concept of the invention that such straps 14 are elastic so as to provide user comfort.

In the most simple embodiment of the invention the top of the holder member 4 has a clip 24 disposed thereon that simply engages a belt of an individual or even the waist band in case the user does not wear a belt.

In another embodiment there is a strap 28 engageable with the holder member 4 and at the top of the strap 28 there is a clip 26 for engagement with a belt loop.

In yet another embodiment of the invention the circumferential straps 12 may be flexible or elastic so as to be able to securely hold various size containers.

While the presently preferred embodiments of the invention have been discussed in considerable detail above, it should be obvious to those persons who are skilled in the art that various modifications and adaptations of the present invention can be made without departing from the spirit of the invention and the scope of the appended claims.

I claim:

1. An apparatus for holding a beverage container, said apparatus comprising:

(a) a holder member including:

(i) an elongated main portion disposed generally vertically, said elongated main portion defining a top edge, a bottom end and a pair of side edges during use of said apparatus when said holder member is attached to a user, (ii) a pocket disposed adjacent only a bottom end of said main portion, said pocket configured to receive a bottom end of the beverage container therewithin, (iii) two continuous straps, each of said two continuous straps, comprising each end thereof attached to a respective side edge of said main portion, said two straps being disposed in a spaced apart parallel relationship to each other along a length of said elongated main portion and between a top edge of said pocket and said top edge of said elongated main portion, one of said two straps is disposed at a distance from said top edge of said elongated main portion and the other one of said two straps is disposed at a distance from said top edge of said pocket and toward said top edge of said elongated main portion;

(b) means for attaching said holder member to the user.

2. The apparatus, according to claim 1, wherein said means is selected from the group consisting of a clip, a strap, a belt, a loop, snaps, and hook and loop material.

3. The apparatus, according to claim 1, wherein said means for attaching said holder member to the user comprises a pair of wings, each of said pair of wings extending outwardly from said respective side edge of said elongated main portion generally planar therewith and having a pair of edges tapering toward each other away from said respective side edge of said elongated main portion, one tapered edge of said each of said pair of wings is disposed at a distance from and below said top edge of said elongated main portion during use of said apparatus, and another tapered edge of said each of said pair of wings is positioned adjacent said top edge of said pocket.

4. The apparatus, according to claim 1, wherein said means for attaching said holder member to the user comprises a strap extending outwardly from said top edge of said elongated main portion and a clip connected to a distal end of said strap for engagement with a belt loop.

5. The apparatus, according to claim 1, wherein said means for attaching said holder member to the user comprises a clip extending from said top edge of said elongated main portion, said clip configured to engage a belt or a waist band of the user.

6. The apparatus, according to claim 1, wherein a material of said holder member is selected from a group consisting of leather, plastic, rubber and combinations thereof.

7. The apparatus, according to claim 1, wherein said each of said two straps is elastic.

8. The apparatus, according to claim 1, wherein said pocket is formed from a mesh material so as to prevent liquid from collecting therein.

9. An apparatus for holding a beverage container while a user is engaging in one of walking, running, and sporting activities, said apparatus comprising:

(a) a holder member including:

(i) an elongated main portion disposed generally vertically when said holder member is attached to the user, (ii) a pocket disposed adjacent only a bottom end of said main portion, said pocket being configured to receive a bottom end of the beverage container therewithin, said pocket being manufactured from a mesh material so as to prevent any liquid from collecting therewithin, (iii) two continuous straps, each of said two continuous straps, comprising each end thereof attached to a respective side edge of said main portion, said two straps are disposed in a spaced apart parallel relationship to each other along a length of said elongated main portion and between a top edge of said pocket and a top edge of said elongated main portion, and (iv) wherein said holder member is configured to hold the beverage container in a generally vertical direction when said holder member is attached to the user; and (b) a pair of wings, each of said pair of wings extending outwardly from said respective side edge of said elongated main portion generally planar therewith and having a pair of edges tapering toward each other away from said respective side edge of said elongated main portion, one tapered edge of said each of said pair of wings is disposed at a distance from and below said top edge of said elongated main portion during use of said apparatus, said pair of wings being sized to encircle the waist of the user.

10. The apparatus, according to claim 9, wherein said elongated main portion of said holder member, said pair of wings and said two straps are formed as a single unit.

11. The apparatus of claim 9, wherein said two straps are disposed generally horizontally when said apparatus is attached to the user.

12. The apparatus of claim 9, wherein said two straps are disposed generally horizontally during use of said apparatus, so that the beverage container when inserted into said pocket is caged between said two straps and said surface of said elongated main portion.

13. The apparatus of claim 9, wherein another edge of said each of said pair of wings is positioned adjacent said top edge of said pocket.

14. The apparatus of claim 9, wherein one of said two straps is disposed at a distance from said top edge of said elongated main portion and the other one of said two straps is disposed at a distance from said top edge of said pocket and toward said top edge of said elongated main portion.

15. An apparatus for holding a beverage container while a user is engaging in one of walking, running, and sporting activities, said apparatus comprising:

(a) a holder member including:

(i) an elongated main portion disposed generally vertically when said holder member is attached to a waist of the user, (ii) a pocket disposed adjacent only a bottom end of said elongated main portion and configured to receive a bottom end of the beverage container therewithin, (iii) two continuous straps, each of said two continuous straps, comprising each end thereof directly attached to a respective side edge of said main portion, said two straps are disposed in a spaced apart parallel relationship to each other along a length of said elongated main portion and between a top edge of said pocket and a top edge of said elongated main portion, and (iv) wherein said holder member is configured to hold the beverage container in a generally vertical direction when said holder member is attached to the waist of the user; and (b) means for attaching said holder member to the waist of the user.

16. The apparatus, according to claim 15, wherein said means for attaching said holder member to the is selected from the group consisting of a clip, a strap, a belt, a loop, snaps, and hook and loop material.

17. The apparatus, according to claim 15, wherein said means for attaching said holder member to the user comprises a pair of wings, each of said pair of wings extending outwardly from said respective side edge of said elongated main portion generally planar therewith and having a pair of edges tapering toward each other away from said respective side edge of said elongated main portion, one tapered edge of said each of said pair of wings is disposed at a distance from and below said top edge of said elongated main portion during use of said apparatus, and another tapered edge of said each of said pair of wings is positioned adjacent said top edge of said pocket.

18. The apparatus, according to claim 15, wherein said pocket of said holder member is manufactured from a mesh material so as to prevent any beverage from collecting therein.

* * * * *